United States Patent [19]

Bailey

[11] 4,422,018

[45] Dec. 20, 1983

[54] AUTOMATIC LIGHTING DISCONNECT TIMER INCORPORATING AN ACOUSTIC ABORT SWITCH

[76] Inventor: Alan S. Bailey, 50 Keegans La., Great Kills, Staten Island, N.Y. 10308

[21] Appl. No.: 416,257

[22] Filed: Sep. 9, 1982

Related U.S. Application Data

[63] Continuation of Ser. No. 241,108, Mar. 6, 1981, abandoned.

[51] Int. Cl.[3] ..... H05B 37/02

[52] U.S. Cl. ..... 315/360; 315/149; 315/363; 340/600

[58] Field of Search ..... 340/567, 600; 315/360, 315/363

[56] References Cited

U.S. PATENT DOCUMENTS

| | | | |
|---|---|---|---|
| 3,706,004 | 12/1972 | Schwartz | 315/71 |
| 3,761,912 | 9/1973 | Stettner | 315/360 |
| 3,780,260 | 12/1973 | Elsner | 219/271 |
| 3,818,213 | 6/1974 | Rockford et al. | 240/10 |
| 4,157,625 | 6/1979 | Bowser | 40/427 |
| 4,164,823 | 8/1979 | Marsico | 40/427 |
| 4,196,461 | 4/1980 | Geary | 362/259 |
| 4,256,009 | 3/1981 | Verduin et al. | 84/464 |
| 4,298,868 | 11/1981 | Spurgeon | 340/755 |
| 4,305,021 | 12/1981 | Schreiden | 315/360 |
| 4,346,427 | 8/1982 | Blissett | 340/600 |

*Primary Examiner*—Harold A. Dixon

*Attorney, Agent, or Firm*—Morgan, Finnegan, Pine, Foley & Lee

[57] ABSTRACT

There is disclosed apparatus which is inserted in an electrical circuit, such as, for example, between an incandescent lamp and the socket therefor, to provide automatic disconnection or opening of the circuit after a predetermined time period and which includes an acoustically activated abort means to interrupt the disconnect cycles and means to reset the cycle for another predetermined time period. The apparatus may be installed, as mentioned, between an incandescent lamp and the socket therefor, installed in a common wall switch, incorporated into a common appliance receptacle or plugged into a common electrical outlet between the outlet and an electrical appliance or a lighting system.

10 Claims, 6 Drawing Figures

AUTOMATIC LIGHTING DISCONNECT TIMER INCORPORATING AN ACOUSTIC ABORT SWITCH

CROSS-REFERENCES TO RELATED APPLICATIONS

This application is a Continuation of copending U.S. patent application Ser. No. 241,108, filed Mar. 6, 1981 and entitled Automatic Lighting Disconnect Timer Incorporating An Acoustic Abort Feature, now abandoned.

This invention relates to an automatic circuit control apparatus. More particularly, the invention relates to apparatus for controlling a circuit and which may be inserted, for example, between an incandescent lamp and the socket therefor to provide automatic disconnection of the lamp after a predetermined time period and includes acoustically activated abort means to interrupt the disconnect cycle and reset means for resetting the lamp for another predetermined time cycle or period.

BACKGROUND OF THE INVENTION

A wide variety of lighting systems or devices embodying timing means and various types of switches are known. For example, U.S. Pat. No. 3,706,004 discloses a combination light and switch construction in which the switch and lamp are located in a housing which can be partially turned in one direction for closing the switch and lighting the lamp while turning the housing in the opposite direction will open the switch and turn off the lamp. On the other hand, U.S. Pat. No. 3,780,260 discloses a combination night light and vaporizer for liquids in which a plug-in electric wall-bracket receives a throw-away container in the form of a dispensing package which contains a vaporizable liquid. A lamp in the bracket provides a heat source for vaporizing the liquid, as well as illumination for the night light. The lamp is controlled through an energizing circuit which includes an electric flow path in the vaporizable liquid between spaced electrodes built into the container and an overriding manually operable switch enables the establishment of a circuit between the electrodes when there is no liquid in the container.

In U.S. Pat. No. 3,818,213 there is disclosed a decorative lamp in which a source of low level light in a concentrated form is incorporated with cast decorative elements to achieve a decorative appearance of the article due to the distribution and emanation of the light from the cast portions.

An entertainment Lighting Display is disclosed in U.S. Pat. No. 4,157,625 in which the display is of relatively thin proportions but produces a visual image of substantial depth by creating multiple reflections of light sources and objects within a narrow space by means of mirrors and repeated reflections back-and-forth between the mirrors.

U.S. Pat. No. 4,164,823 discloses a luminous effects device which is provided with a plurality of lamps, a partially silvered mirror and a spherical reflector located within a container and shaped and arranged to provide an endless tunnel effect when received from one side. Through means of a suitable light driver which is sensitive to an audio input, such as music, the lights may be made to blink, change in intensity and burning sequence and the like, thus creating variable luminous effects. On the other hand, U.S. Pat. No. 4,298,868 discloses an apparatus which produces an optical illusion of variable geometric patterns through an array of variably controlled light emitting diodes mounted on a rotating disk or carrier.

U.S. Pat. No. 4,256,009 deals with a disco lamp controller for a coin-operated phonograph in which a signal derived from an audio amplifier signal of the phonograph is employed to trigger lamps to light in time to the beat of music being played on the phonograph.

Still another pattern generating entertainment device is disclosed in U.S. Pat. No. 4,196,461 in which a collimated light source is directed at a plurality of controllably rotatable mirrors which can be turned to achieve different light patterns. Further variations of the light pattern can be attained by an analog, that is audio, signal to modify the light beam.

While the above mentioned patents disclose useful and acceptable apparatus of varying degrees of complexity for achieving their stated purposes, it is to be noted that they do not deal with a device or apparatus which will disconnect, that is open a circuit after a predetermined time period in order to conserve energy and which disconnect cycle can be interrupted and reset for another predetermined time cycle by an acoustically activated abort means. There exists, therefore, a need for an automatic control apparatus which can accomplish the latter purpose and the instant invention fullfills this need.

BRIEF STATEMENT OF THE INVENTION

In accordance with the invention there is provided apparatus for controlling an electrical circuit that will automatically disconnect, that is open, the circuit after a predetermined time interval and to interrupt the disconnecting or opening of the circuit and reset the predetermined time interval in response to an acoustic signal and which comprises in combination timing means capable of being set for a predetermined time interval to maintain the circuit in an operating mode for the predetermined time interval and including means to interrupt the circuit and open the same at the termination of the predetermined time interval, and means for generating a signal near the termination of the predetermined time interval indicating the approaching termination thereof; acoustic means connected to the timing means for generating a signal in response to acoustic stimulation and aborting the completion of the predetermined time interval and means for resetting the predetermined time interval in response to the signal from the acoustic means.

THE DRAWINGS

In order to understand the invention more fully, reference is directed to the accompanying drawings wherein.

DESCRIPTION OF THE PREFERRED EMBODIMENTS

Figure 1:
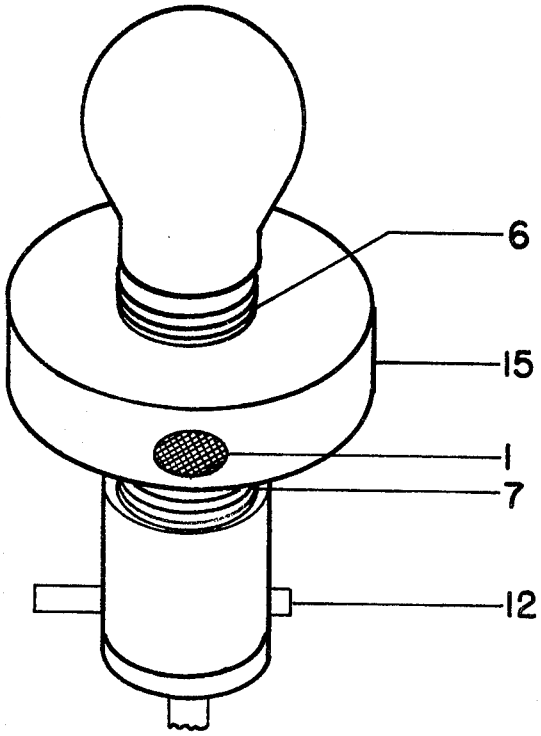
FIG. 1 is a view in perspective of one embodiment of the invention installed in a common lamp socket.

Referring now more particularly to FIG. 1, in the embodiment of the invention illustrated there the apparatus of this invention is enclosed in an insulated housing or casing 15 with the sound or acoustic detecting device 1 of the acoustic means, being disposed in the surface of the housing. The housing is provided with a male base or member 7, suitably adapted for insertion into a common electrical socket receptacle, and a female receptacle 6 adapted to receive an incandescent lamp. The socket is provided with a switch 12. Upon closing switch 12, or a remote switch (not shown), electricity is conducted through the apparatus of the invention disposed in the housing to the female receptacle 6 and thence to the incandescent lamp, energizing the same for a predetermined time interval which commences in the timing means of the inventive apparatus disposed in the housing at the moment switch 12 is closed. When the predetermined time interval nears its termination, the means for generating a signal indicating the approaching termination of the time interval located within the housing causes the lamp to blink, thus warning an individual that the circuit will open and the lamp will be turned off if no action is taken. On the other hand, if a sound is received at the sound detecting device 1 of the acoustic means, it is amplified and will abort the predetermined time interval and reset the timing means by actuating the means for resetting the predetermined time interval, also located within the housing, in response to the signal from the sound detecting device 1 of the acoustic means. When a predetermined time interval is completed and no sound is received, the lamp is turned off and will remain off until such time as switch 12 is turned off and then on. This off-on sequence will reset the apparatus or another predetermined time interval or cycle.

Figure 2:
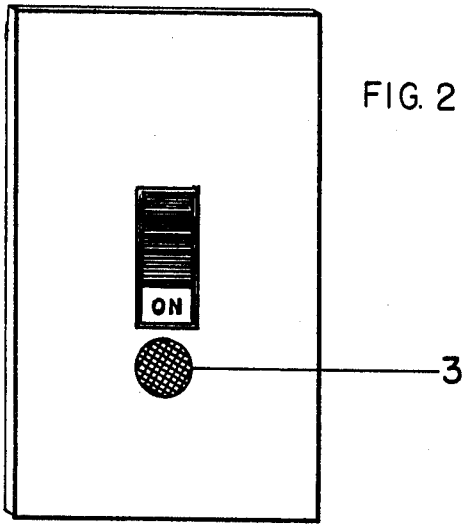
FIG. 2 is a view in perspective of another embodiment of the invention installed in a common wall switch device.

Turning next to FIG. 2, in the embodiment of the invention illustrated there the apparatus of the invention is disposed in a standard wall switch configuration provided with a standard switch lever and the sound detecting device 3 of the acoustic means to amplify sound energy for control purposes. The timing means and all of the other elements of the apparatus of the invention are disposed in the switch box which acts as the housing therefor. The unit operates like the embodiment of FIG. 1 discussed above, being reset by operating the switch lever to an off and then to an on position.

Figure 3:
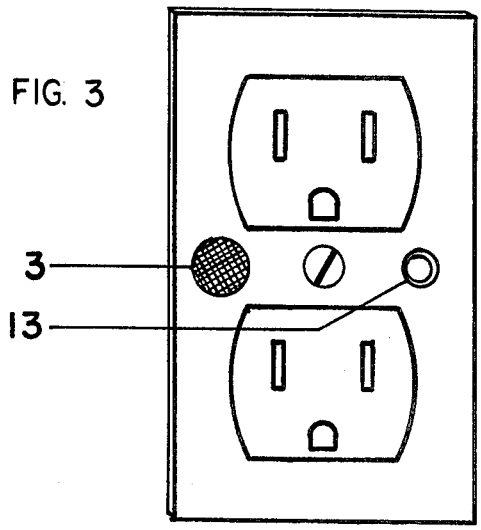
FIG. 3 is a view in perspective of another embodiment of the invention installed in a common appliance receptacle and including a manual reset button to initiate resetting.

FIG. 3 represents another embodiment of the invention in which the apparatus of the invention is incorporated into a standard wall receptacle which forms the housing and includes sound detecting device 4 of the acoustic means to amplify sound energy for control purposes and a manual reset button 13. The unit is reset from a remote wall switch (not shown) or by operating the reset button 13.

Figure 4:
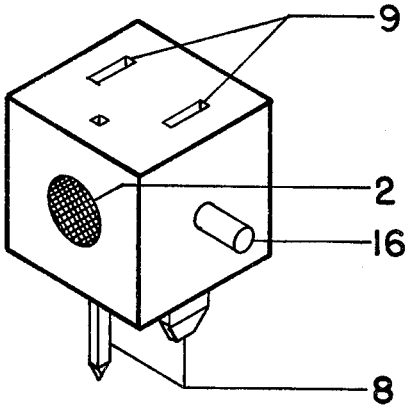
FIG. 4 is a view in perspective of another embodiment of the invention constructed for installation in a common wall receptacle and provided to receive a common plug of an appliance.

FIG. 4 represents another embodiment of the invention in which the apparatus of the invention is disposed in a housing provided with male blade members or prongs 8 and a female prong receptacle 9. This form of the invention may be inserted into any standard electrical wall receptacle, providing electrical connection with prongs 8 and any electrical appliances such as a lamp, radio, television set or the like, may be connected to the device by inserting the blade members of its electrical plug into the female blade receptacle 9. The sound detector device 2 of the acoustic means is disposed on the housing to amplify the sound energy for control purposes and a reset button 16 is also included to manually reset the circuit if the power to the device cannot be turned off and then restored thereto in another way.

Figure 5:
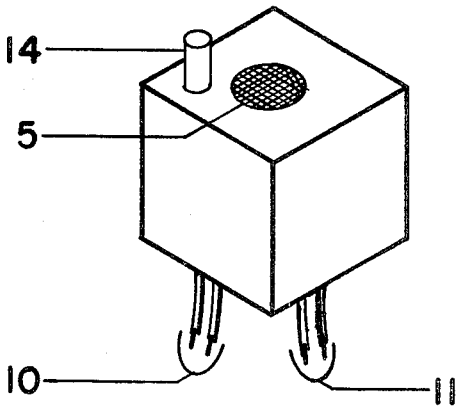
FIG. 5 is a view in perspective of another embodiment of the invention constructed as a universal block provided with means for connecting this embodiment of the invention into a custom circuit installation.

FIG. 5 represents a further embodiment of the invention which provides a device that can be incorporated into a custom designed product. As shown, the device has a housing and two power input wires or leads 11 and two power output wires or leads 10 extending to the outside of the housing. The sound detecting device 5 of the acoustic means amplifies sound energy for control purposes. The unit is reset by a remote switch (not shown) or by using the manual reset switch button 14.

It is to be understood that in any of the embodiments discussed above the inventive apparatus includes the timing means, the means for generating a signal indicating the approaching termination of the predetermined time interval, the acoustic means and the means for resetting the predetermined time interval, all being incorporated into the various configurations, such as the wall switch or wall receptacle which operate as the insulated housing therefor.

Figure 6:
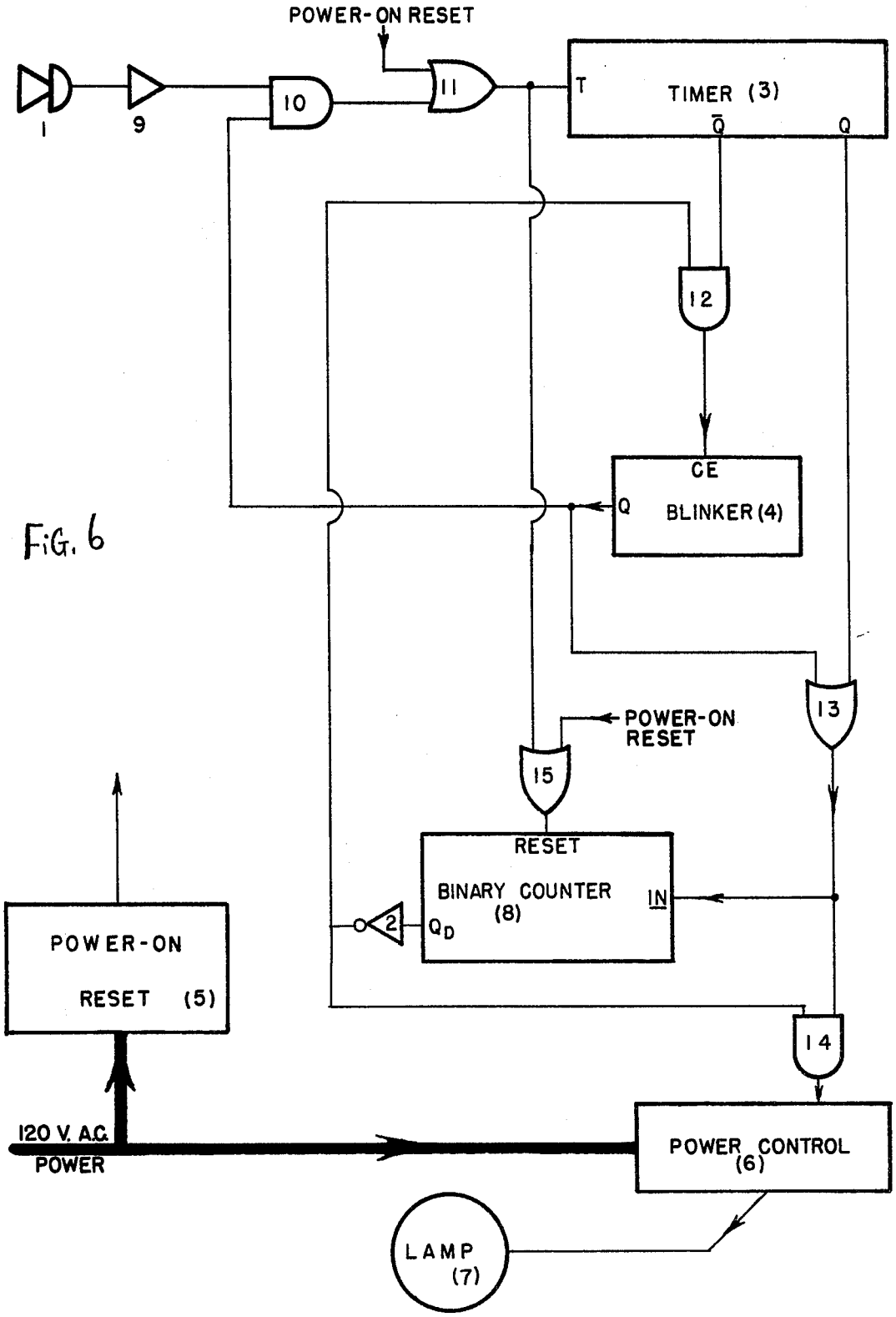
FIG. 6 is a logic diagram illustrating the various electrical components and their relationship with each other in accordance with the invention.

Set forth hereinafter and as shown in FIG. 6 is the operating sequence which the inventive apparatus carries out no matter what the physical configuration of the housing might be.

1. The power-on reset 5 produces a positive pulse whenever the power is first applied to the invention. This positive pulse is applied to both OR gate 11 and OR gate 15. The power-on reset 5 sends a pulse to start the timing means, that is monostable timer 3, which includes means to interrupt the circuit and open the same at the termination of the predetermined time interval, through the resetting means, that is counter 8 and OR gate 15 and OR gate 11 and resets counter 8 to zero through OR gate 15 thus initializing Qd low.

2. The timer 3 just activated produces a HIGH at timer 3 output Q which passes through OR gate 13 to activate AND gate 14 along with the resulting HIGH, resulting from the inversion of Qd through inverter 2. This activates the power module 6 to light the lamp 7.

3. When the timer 3 cycle is completed, timer 3 output "not Q" goes HIGH and along with inverted Qd output activates AND gate 12 to enable blinker 4, that is the means for generating a signal indicating the approaching termination of the predetermined time interval, to operate at about 1 hertz.

4. The blinker 4 Q is initially zero and now HIGH and activates AND gate 10 which will allow any sound from the acoustic means, that is microphone 1 amplified at 9 to pass through OR gate 11 and retrigger time 3 if sound is present. In addition, blinker 4 Q will also pass through OR gate 13 and increment binary counter 8. If sufficient sound is detected, the pulse will pass from amplifier 9 through AND gate 10, OR gate 11 and also reset counter 18 through OR gate 15. The sequence then returns the step 1 of this description. If not, it will continue to step 5.

5. When the output of the blinker 4 is low, the microphone 1 is deactivated and the lamp 7 is off.

6. The blinker 4 sequence will continue until binary counter 8 increments until Qd is HIGH. At this point, the HIGH at Qd will, through the inverter 2, apply a LOW at AND gate 14 and block any signal to power module 6 which will in turn deactivate the lamp 7. In addition, this same LOW from inverter 2 will block any further activity of the blinker 4 through AND gate 12 by removing the HIGH that enabled the blinker 4 to operate.

7. At this point all activity will stop until the power line is interrupted and the cycle is reinstated.

It is to be understood that while this invention is described herein in its general application primarily to common household electrical appliances and circuits, it may be utilized in any electrical circuit or circuitry arrangement. Moreover, while the invention, as disclosed, employs a monostable timer, it is further to be understood that it may also be employed in circuits where other types of timers, such as those having a twenty-four hour cycle and variable circuitry arrangements such as, for example, circuitry elements to turn a lighting system on and off at variable periods over the twenty-four hour time cycle are used.

This invention presents numerous advantages. For example, it is relatively simple to manufacture from readily commercially available elements and simple to employ by the general consuming public. In addition, it alleviates needless waste of electrical energy and, consequently, minimizes unnecessary expense to the consumer who must pay the cost of unutilized electricity consumed and, as well, enhances increased replacement time for incandescent lamps or other electrical appliances or devices with which the inventive apparatus is employed. Numerous other advantages of the invention will be readily apparent to those skilled in the art.

It is to be understood, therefore, that this invention is not to be limited to the described embodiments thereof as set forth herein, except as defined in the appended claims.

What is claimed is:

1. Apparatus for controlling an electrical circuit that will automatically disconnect or open the circuit after a predetermined time interval and to interrupt the disconnecting or opening of the circuit and reset the predetermined time interval in response to an acoustic signal comprising in combination timing means capable of being set for a predetermined time interval to maintain the circuit in an operating mode for said predetermined time interval and including means to interrupt the circuit and open the same at the termination of said predetermined time interval, and means for generating a signal near the termination of said predetermined time interval indicating the approaching termination thereof; acoustic means connected to the timing means for generating a signal in response to acoustic stimulation and aborting the completion of said predetermined time interval and means for resetting said predetermined time interval in response to the signal from said acoustic means.

2. Apparatus according to claim 1 wherein the timing means, the means for generating a signal indicating the approaching termination of the predetermined time interval, the acoustic means and the means for resetting said predetermined time interval are disposed in a common electric wall switch.

3. Apparatus according to claim 1 wherein the timing means, the means for generating a signal indicating the approaching termination of the predetermined time interval, the acoustic means and the means for resetting said predetermined time interval are disposed in an electrical wall receptacle adapted to operate at least one electrical appliance.

4. Apparatus according to claim 3 including a manual reset button.

5. Apparatus according to claim 1 including an insulated housing containing the timing means, the means for generating a signal indicating the approaching termination of the predetermined time interval, the acoustic means and the means for resetting said predetermined time interval.

6. Apparatus according to claim 5 wherein the insulated housing is provided with a male base adapted for insertion into an electrical socket receptacle and a female receptacle adapted to receive an incandescent lamp.

7. Apparatus according to claim 5 wherein the insulated housing is provided with male blade members adapted for insertion into an electrical wall receptacle and is adapted to operate at least one electrical appliance.

8. Apparatus according to claim 7 including a manual reset button.

9. Apparatus according to claim 5 wherein the insulated housing is provided with externally exposed wires to permit coupling thereof into an electrical circuit.

10. Apparatus for controlling a lighting circuit that will automatically turn off said lighting provided no response to an audible signal is received after the lighting has been in operation for a predetermined time interval comprising in combination a monostable timer capable of being set for a predetermined time interval including means to interrupt said circuit and turn off said lighting at the termination of said predetermined time interval and means for generating a signal and causing blinking of said lighting near the termination of said predetermined time interval to indicate the approaching termination thereof; electro-acoustic means connected to said monostable timer for generating a signal in response to audible stimulation and aborting the completion of said predetermined time interval and reset means for resetting said predetermined time interval in response to the signal from said electro-acoustic means, said apparatus being disposed in an insulated housing provided with a male base adapted for insertion into an electrical socket receptacle and a female receptable adapted to receive an incandescent lamp.

* * * * *